US008387702B2

(12) United States Patent
Biester

(10) Patent No.: US 8,387,702 B2
(45) Date of Patent: Mar. 5, 2013

(54) MULTICOUPLER

(75) Inventor: Klaus Biester, Wienhausen (DE)

(73) Assignee: Cameron International Corporation, Houston, TX (US)

( * ) Notice: Subject to any disclaimer, the term of this patent is extended or adjusted under 35 U.S.C. 154(b) by 589 days.

(21) Appl. No.: 12/602,290

(22) PCT Filed: May 31, 2007

(86) PCT No.: PCT/EP2007/004834

§ 371 (c)(1),
(2), (4) Date: Nov. 30, 2009

(87) PCT Pub. No.: WO2008/145168

PCT Pub. Date: Dec. 4, 2008

(65) Prior Publication Data

US 2010/0200240 A1 Aug. 12, 2010

(51) Int. Cl.
*E21B 33/038* (2006.01)

(52) U.S. Cl. ..... 166/338; 166/339; 166/340; 166/341

(58) Field of Classification Search ..... 166/338–341, 166/344, 351, 360, 365, 378
See application file for complete search history.

(56) References Cited

U.S. PATENT DOCUMENTS 4,585,369 A * 4/1986 Manesse et al. ..... 403/322.3
4,637,470 A * 1/1987 Weathers et al. ..... 166/344
5,024,467 A * 6/1991 Truchet ..... 285/365
5,051,103 A * 9/1991 Neuroth ..... 439/192
5,203,374 A * 4/1993 Smith, III ..... 137/614.04
5,417,459 A * 5/1995 Gray et al. ..... 285/26
5,681,127 A * 10/1997 Willen ..... 403/322.1
6,053,253 A * 4/2000 Nicholson ..... 166/368
2004/0127084 A1 7/2004 Glennie et al.

* cited by examiner

*Primary Examiner* — Thomas Beach
*Assistant Examiner* — James Sayre
(74) *Attorney, Agent, or Firm* — Chamberlain Hrdlicka

(57) ABSTRACT

A multicoupler, particularly for gas or oil production, comprises at least one male and one female part. Said parts comprise a plurality of fluid coupling members which can be assigned to one another and which are in engagement with one another when male part and female part are in the coupling position. One of the parts comprises a connecting means including a spindle, which connecting means in the coupling position is in engagement with a mating connecting means on the other part.

To improve a multicoupler of this type such that with a simplified constructional configuration and without destruction of parts of the multicoupler a coupling position can also be reliably maintained upon further rotation of the spindle, the connecting means comprises a threaded section rotatable by said spindle and the mating connecting means comprises a mating threaded section and a free-rotating chamber, the threaded section being helically movable along the mating threaded section up into the free-rotating chamber while occupying the coupling position.

31 Claims, 3 Drawing Sheets

MULTICOUPLER

CROSS-REFERENCE TO RELATED APPLICATIONS

The present application claims the benefit of priority to PCT/EP2007/004834 filed May 31, 2007, which is incorporated herein by reference in its entirety for all purposes.

STATEMENT REGARDING FEDERALLY SPONSORED RESEARCH OR DEVELOPMENT

Not applicable.

The present invention relates to a multicoupler, particularly for (subsea) gas or oil production, the multicoupler comprising at least one male part and one female part. Each of said parts comprises a plurality of fluid coupling members which can be assigned to one another. When male and female parts are in the coupling position, the fluid coupling members are in engagement with one another. The male or female part comprises a connecting means which includes a spindle and which in the coupling position is in engagement with a mating connecting means on the other part.

Such a multicoupler is e.g. known from US 2004/0127084 A1. Said device is particularly used for connecting manifolds, or the like, to a line or a plurality of lines. Male and female parts are drawn together and, in a first position, corresponding members of a bayonet fitting get into contact with one another as connecting means and mating connecting means. In this position the connecting means that comprises a spindle is then rotated by means of said spindle to such an extent that, when male part and female part are further drawn together, a coupling position is established and the bayonet fitting is simultaneously arranged in its closing position.

In this coupling position, the corresponding fluid coupling members are also interconnected in fluid-tight fashion.

With such a multicoupler it is possible that the spindle is further rotated even after the coupling position has been reached, and guide pins which are guided along a guide mechanism upon rotation of the spindle at least up into the coupling position shear off as a safety measure for avoiding an overload on the multicoupler.

The guide pins are part of the male part, so that said part must be replaced after a shearing off of the guide pins.

It is the object of the present invention to improve a multicoupler of the aforementioned type such that with a simplified constructional configuration and without destruction of parts of the multicoupler the coupling position is safely maintained even upon further rotation of the spindle.

This object is achieved by the features of patent claim 1 and patent claims 30 and 31.

According to the invention the connecting means comprises a threaded section which is rotatable by the spindle, and the mating connecting means comprises a mating threaded section. These are adapted to be screwed to one another, whereby male part and female parts are drawn together up to the coupling position. Apart from the mating threaded section, the mating connecting means further comprises a free-rotating chamber. When the coupling position has been assumed, the threaded section has helically moved along the mating threaded section up into the free-rotating chamber. In this free-rotating chamber, there is no longer any engagement between threaded section and mating threaded section, so that the threaded section can freely rotate in the free-rotating chamber by further rotation of the spindle. This means that also upon further rotation of the spindle male part and female part are not further drawn together after the coupling position has been occupied. Instead of this, the corresponding threaded section is rotating in the free-rotating chamber and the spindle can be further rotated in any desired way without excessively large forces arising between male and female parts.

Shearing guide pins or other parts with predetermined breaking points that are to prevent excessive load on male part and female part are not required according to the invention.

In principle, it is possible that the threaded section is formed on a separate part which is detachably connected to the spindle only for rotating the threaded section relative to the mating threaded section. In a simplified embodiment, however, the threaded section may be configured essentially at a free end of the spindle.

As a rule, the female part is stationarily arranged, particularly on a subsea device, such as a subsea production tree or the like. The male part can be moved by a diver or a remote-controlled vehicle, such as a ROV, to approach the female part for establishing the coupling position and thus for connecting the fluid coupling members. Likewise, the corresponding rotation of the spindle can be executed by a diver, ROV, or the like. It is also possible that the spindle has coupled thereto a remote-controlled drive which causes the corresponding rotational movement for both establishing the coupling position and (see the further description) releasing the coupling position.

To be able to reliably determine the coupling position through a corresponding contact of the parts, female part and male part may comprise end plates assigned to one another, from which the fluid coupling members project towards the respectively other end plate. The corresponding fluid coupling members may be distributed particularly variably in the end plate. Inside the parts the fluid coupling members are connected to corresponding feed lines.

To be able to arrange and support the spindle in the area of the end plate in a simple way, it is regarded as advantageous when the end plate of the male part comprises a substantially central bearing bore on which the spindle is supported at least rotatably and projects with its threaded section accordingly to the coupling members. In this case the threaded section may project further than the corresponding coupling members, so that prior to a contacting of the various fluid coupling members of male part and female part, an engagement of threaded section and mating threaded section has already been established. This prevents the fluid coupling members from being possibly damaged when male part and female part are drawn together because a contact of the corresponding connecting means is first established.

The spindle may be supported in the corresponding bearing bore not only in a rotatable but also axially displaceable manner.

By analogy, the end plate of the housing of the female part may comprise a screw-in bore with the mating threaded section in the extension of which the free-rotating chamber is arranged. The coupling position is thereby defined by simply screwing the threaded section to the mating threaded section up into the free-rotating chamber and free rotatability of the threaded section in the free-rotating chamber is subsequently accomplished after the coupling position has been occupied.

It is in principle possible that the free-rotating chamber is arranged on a backside of the female part, so that it is substantially arranged outside the female part. However, it is of advantage to the protection of the means when the free-rotating chamber is assigned to the female part.

In a further embodiment, the mating threaded section is configured as an internal thread and the threaded section as an external thread. A reverse configuration is also possible. The corresponding thread flanks may be formed as a trapezoidal thread, V-thread, flat thread, round thread, or the like. The threads may be standard threads or also left-hand threads and also oval threads.

Particularly in oil production it is partially customary that the male part is moved through a preliminary labyrinth while being inserted into the female part. This can e.g. be accomplished according to the invention in that the female part comprises a receptacle that is open outwards towards the male part, and along which the male part is displaceable in insertion direction up into the coupling position.

In this connection it may be regarded as a further advantage when the receptacle comprises a guide means extending in insertion direction, along which the male part is guided in non-rotational, but axially displaceable fashion. This guide means ensures that the corresponding fluid coupling members are correctly assigned to one another in precisely fitting fashion. These members are normally not arranged in the center of the corresponding plate, but are distributed over the corresponding plate surface.

Such a guide means can be realized in a simple way in that said guide means comprises at least one guide slot along which a guide bar is movable that is projecting substantially radially outwards from the male part.

Such a guide bar may also be configured as a wedge or a key.

Of course, it is also possible that two or more guide slots are used as guide means with corresponding guide bars.

To permit an exact assignment between guide slot and guide in a simple way when male part and female part are drawn together, the receptacle may comprise an insertion expansion in the area of the receiving opening. Said expansion automatically centers the guide bar relative to the guide slot upon further approach to the guide bar and permits a pinpoint assignment.

When the spindle is operated from the outside by a diver, a ROV, or the like, it is possible that the spindle is provided at its end opposite to the threaded section with an engagement section for engagement of a rotating means. Such a rotating means may e.g. be a hand tool which is operated by a diver. Such a rotating means may also be an automatic tool of a ROV or the like.

A simple example of such an engagement section is a square-end section of the spindle.

To define in a simple way by which force male part and female part rest on one another in the coupling position and the fluid coupling members are coupled to one another, the spindle may be force-actuated in a direction opposite to the end plate of the male part. In case the threaded section is turned into the mating threaded section and finally reaches the free-rotating chamber, the coupling position being occupied at this moment, the force then acting on the spindle defines the support forces or contact forces between male and female part or between the fluid coupling members.

Attention should particularly be paid in addition that the corresponding force actuation is determined for the moment where male part and female part are in the coupling position. It is possible that the force actuation depends on the screwing position of the threaded section in the screw-in bore. This means that the force actuation is increasing during screwing of threaded section and mating threaded section until the coupling position is reached.

A simple possibility of such an actuation with a force is the use of at least one spring element which is supported between spindle and remaining male part. Of course, other types of force actuation are also possible.

For a simple arrangement of the spring element a spring-element receiving chamber extends partly along the spindle and the spring element may be arranged between an abutment end of said chamber that is surrounding the spindle, and a spring stop connected to said spindle. The corresponding spring element is here supported with its ends on the abutment end on the one end and the spring stop on the other hand. As a result force actuation takes place in a direction away from the corresponding end plate.

Upon rotation of the spindle and screwing of threaded sections and mating threaded sections the spindle is displaced axially relative to the remaining male part, so that the force actuation is thereby varied accordingly through the spring element. This can particularly be accomplished in a simple way when the spring stop variably defines the spring-element receiving chamber facing the abutment end. When the spring stop gets closer to the abutment end, the spring element is e.g. compressed more strongly. The spring element may here be formed as a helical compression spring. However, other types of springs can also be used, for instance disk springs, square springs, or the like. The spring element may be selected depending on the workload and the connection stroke of the corresponding fluid coupling members.

It should once again be pointed out that in the coupling position the spring element will apply the corresponding force that is e.g. needed for producing the necessary sealing forces between the fluid coupling member. The corresponding force actuation can be varied by the manufacturers of such fluid coupling members with respect to the necessary connection stroke or other requirements and predetermined for the coupling position.

To permit both the rotational and axial movement of the spindle with less friction, a bearing bush may be arranged between abutment end and open end of the bearing bore at least partly in the longitudinal spindle direction.

To permit a contacting of the engagement section in a targeted manner, particularly in the case of a ROV, the spindle may be arranged substantially from the spring stop up to the engagement section within a receiving sleeve of the male part that is open at one side. Said receiving sleeve may serve as a coupling means for a corresponding mating coupling element of the ROV (remote operated vehicle). This assignment then ensures a corresponding assignment of engagement section and rotating means.

It might be possible that due to a wrong operation of the ROV, or due to vibrations of the corresponding subsea device, or the like, the spindle is rotated or turned back independently, whereby said spindle leaves the free-rotating chamber possibly with its threaded section and gets again into engagement with the mating threaded section. As a consequence, the coupling position is no longer defined in a clear way and the tightness of the interconnected fluid coupling members might thus be affected. To prevent such a back rotation, the spindle may comprise a securing section of reduced diameter next to the engagement section. This securing section prevents an unintended axial displacement of the spindle or an unintended rotation of the spindle, for instance by attaching a ring or the like.

It is possible that engagement section and securing section are substantially of the same diameter, and it is also possible that one of the sections has a larger diameter.

It is also conceivable that an anti-back rotation means is assigned in a different way to the spindle for preventing an independent back-rotation of the spindle out of the coupling position.

An example considered to be advantageous in this connection is an anti-back rotation means which comprises at least one locking spring that with an arrangement in the coupling position rests on a radially outwardly projecting spring stop defining the securing section towards the spring element.

If in this connection the spindle is moved with its threaded section up into the free-rotating chamber and the coupling position is thereby occupied, the locking spring automatically snaps behind the spring stop, so that the spindle cannot turn back without detachment of the locking spring.

A simple possibility of arranging the locking spring and also of engaging the spindle can be seen in the measure that the locking spring extends substantially in a direction transverse to the longitudinal direction of the spindle and is detachably secured to upper and lower ends in the receiving sleeve. In this instance, it comprises at least two spring legs that can be pressed from the outside onto the spindle.

The locking spring can substantially be configured in U-shaped fashion, the corresponding free ends of the spring legs being detachably connected to each other by a split pin or the like to an outside of the receiving sleeve. This prevents an independent displacement or detachment of the locking spring.

To particularly permit a release of the locking spring by a rotating means of the ROV, the spring legs may comprise, particularly in the area of the spindle, expansions oriented towards the engagement section. When slid upon the engagement section, the rotating means engages into said expansions and expands the locking spring so that it no longer grips behind the spring stop.

At least the expansion can here project in the direction of the engagement section over the securing section along the spindle.

A simple embodiment of a rotating means can be built up e.g. such that it comprises a rotatable tubular section which can be slid onto the engagement section up into a rotational position, and it is only upon the pushing into the rotational position that the spindle can be rotated by the rotating means. Before the rotational position is reached, the locking spring is here expanded.

To simplify the expansion of the locking spring, the tubular section may be provided at its free end with a cone-shaped insertion edge which extends obliquely away from said end radially outwards. This insertion edge is insertable independently of the corresponding rotational position of the tubular section into the expansions of the spring leg for spreading the locking spring.

It is only in a condition in which the locking spring is spread to an adequate degree that the spindle is then rotated, if necessary. To this end, at some distance from its free end, the tubular section comprises a rotating section receiving the engagement section for rotation therewith. The distance between free end and engagement section is here configured such that the locking spring is spread in a reliable way before the engagement section is received for rotation therewith.

Advantageous embodiments of the invention shall now be explained in more detail with reference to the figures attached to the drawing, in which.

Figure 1:
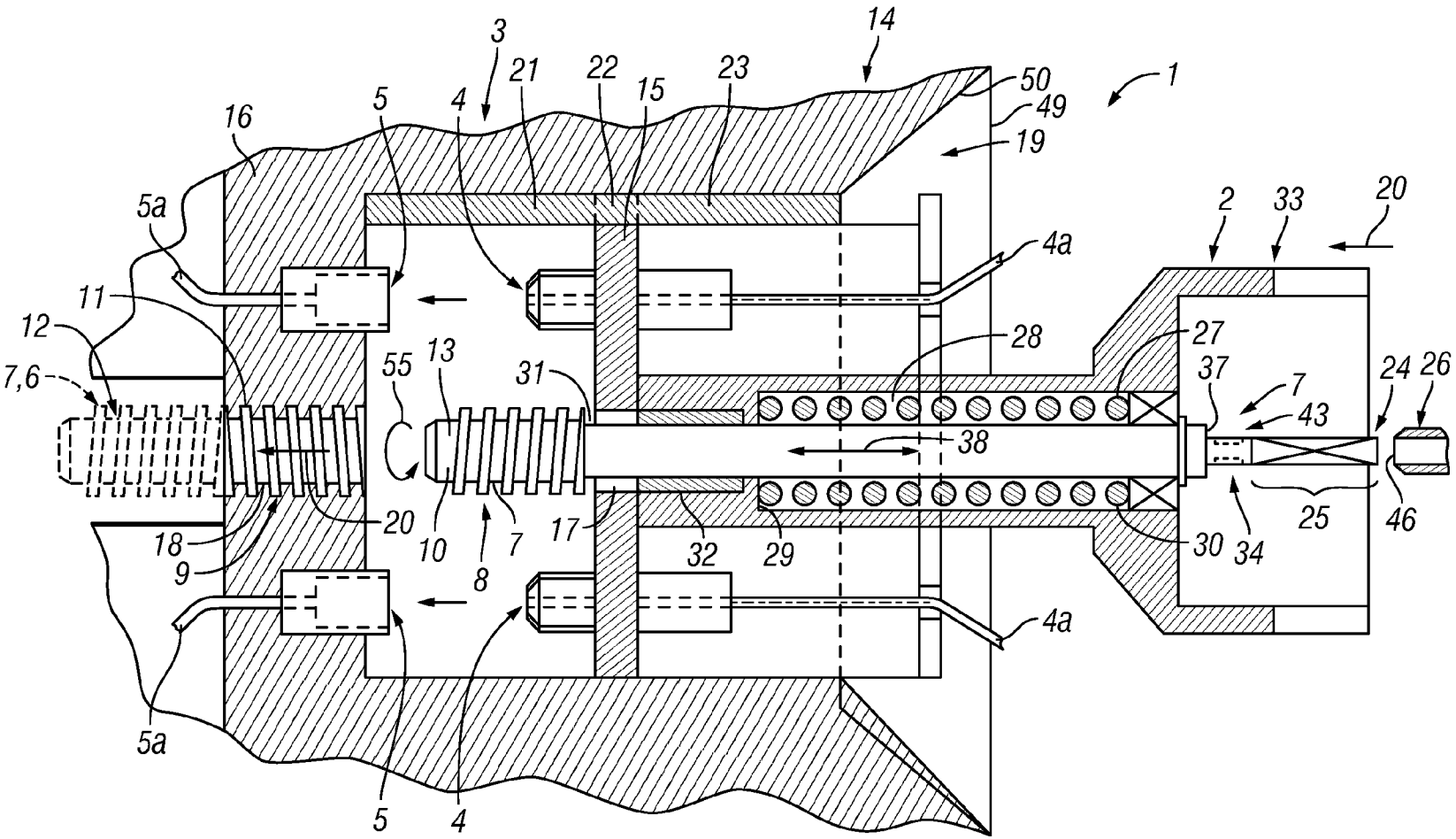
FIG. 1 is a longitudinal section through an embodiment of a multicoupler according to the invention.

FIG. 1 shows a longitudinal section through an embodiment of a multicoupler 1 of the invention. Said multicoupler is arranged with a female part 3 on a subsea device 14, e.g. a production tree, or the like, and serves as a component in oil or gas production. The female part 3 is fastened to the corresponding subsea device 14 and comprises a receptacle 19 which is open at one side. In the area of its receiving opening 49, said receptacle comprises insertion expansions 50 extending obliquely radially to the outside.

At its end opposite the receiving opening 49, the receptacle 19 comprises an end plate 16 of a housing. This plate has arranged therein a number of fluid coupling members 5 which communicate with corresponding fluid lines 5*a* guided into the subsea device 14.

Approximately in the center in the end plate 16, a screw-in bore 18 is arranged with a mating threaded section 11 as internal thread. These are part of a mating connecting means 9 which (see the observations made hereinafter) cooperates with a connecting means 8 of a male part 2.

The screw-in bore 18 extends through the whole thickness of the end plate 16 and is connected to a free-rotating chamber 12 of the female part 3 at the rear side of the end plate 16 that is facing away from the receptacle 19.

A guide means 21 which comprises at least one guide bar 23 extending substantially from the insertion expansion 50 up to the end plate 16 extends along the receptacle 19 in insertion direction 20 for the male part 2.

In FIG. 1, the male part 2 has already been inserted in part into the receptacle 19 of the female part 3. An end plate comprises a guide groove 22 which in the plugged position grips around the guide bar 23 and forms an anti-rotation device and a guide with said bar.

The male part 2 comprises a substantially cylindrical housing, said housing comprising a corresponding end plate 15 at its insertion side oriented towards the end plate 16. Said end plate 15 is slightly reset relative to the outer edges of the housing, with corresponding fluid coupling members 4 projecting from the end plate 15. Said members are in communication with corresponding fluid lines 4*a* in the interior of the male part 2.

The fluid coupling members 4 are sealingly connected with the fluid coupling members 5 when the male part 2 is arranged in the coupling position 6.

Approximately in the center in the end plate 15, a spindle 7 is rotatably supported in a bearing bore 17 as a connecting means 8 in the male part 2. The spindle 7 projects from the end plate 15 in the direction of screw-in bore 18 with a threaded section 10 arranged at its free end 13. Said threaded section 10 matches with the mating threaded section 11 and is e.g. configured as a trapezoidal thread. The threaded section is screwed into the screw-in bore 18 by the threaded section being further drawn towards the mating threaded section and by rotation in rotational direction 55. In this process the end plate 15 is drawn towards the end plate 16 until the corresponding fluid coupling members 4 and 5 get into contact.

FIG. 1 shows the threaded section 10 in broken line in the coupling position 6 in which the fluid coupling members 4 and 5 are tightly connected to each other.

In this coupling position 6, the threaded section 10 is fully screwed through the screw-in bore 18 and is no longer in engagement with the mating threaded section 11. Instead of this, upon further rotation of the spindle 7 said threaded section 10 is arranged to be freely rotatable in the free-rotating chamber 12.

The coupling position 6 can also be defined in addition by contact of the end plates 15 and 16 with one another.

The spindle 7 extends from the threaded section 10 through the bearing bore 17 and further through the male part 2 up to the rear end 24. At said end 24, an engagement section 25 is e.g. configured in the form of a square which can be brought into communication with a rotating means 26 (see also FIG. 6), to rotate the spindle 7 in rotational direction 55 or also in the reverse rotational direction.

Next to the engagement section 25, the spindle 7 comprises a securing section 34.

The securing section 34 is defined at one side by a spring stop 37 and has a smaller diameter than the part of the spindle 7 adjoining the spring stop 37.

In the direction towards the threaded section 10, a further spring stop 30 is arranged subsequent to the spring stop 37 on the spindle in the form e.g. of a ball bearing, or the like. Said further spring stop 30 variably defines a spring-element receiving chamber 28 which extends up to an abutment end 29. This spring-element receiving chamber 28 has arranged therein a spring element 27 which is supported with one end on the abutment end 29 and with its other end on the further spring stop 30. In the illustrated embodiment, the spring element 27 is a helical compression spring which acts on the spindle 7 with a force in a direction opposite to the insertion direction 20.

Following the abutment end 29, a bearing bush 32 extends around the spindle 7 for friction reduction, the bearing bush extending almost up to the open end 31 of the bearing bore 17.

The spindle 7 is rotatable not only in the bearing bore 17, but also axially displaceable in insertion direction 20 and also supported such that it can be retracted or rotated back out of the coupling position 6.

In the area of the securing section 34 and the engagement section 25, the spindle 7 is arranged inside a receiving sleeve 33 of the male part 2. Said sleeve surrounds the spindle 7 in concentric fashion and extends approximately up to the end 24 in the longitudinal direction 38 of the spindle 7. The receiving sleeve 33 serves to receive a coupling member (not shown) of a ROV (remote operated vehicle—operating submarine), or the like, and after said coupling member has been inserted, a corresponding rotating means 26 of such a vehicle is slid onto the end 24 of the spindle 7.

Figure 2:
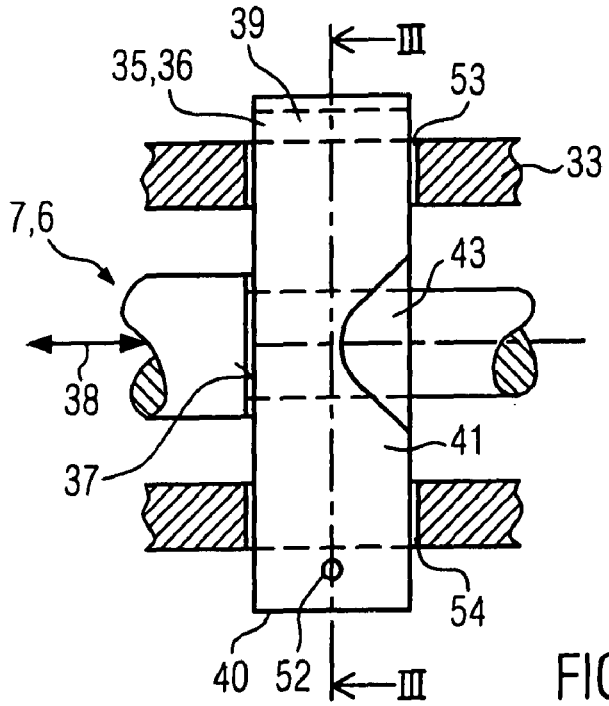
FIG. 2 is an enlarged illustration of a detail of an anti-back rotation device.
Figure 3:
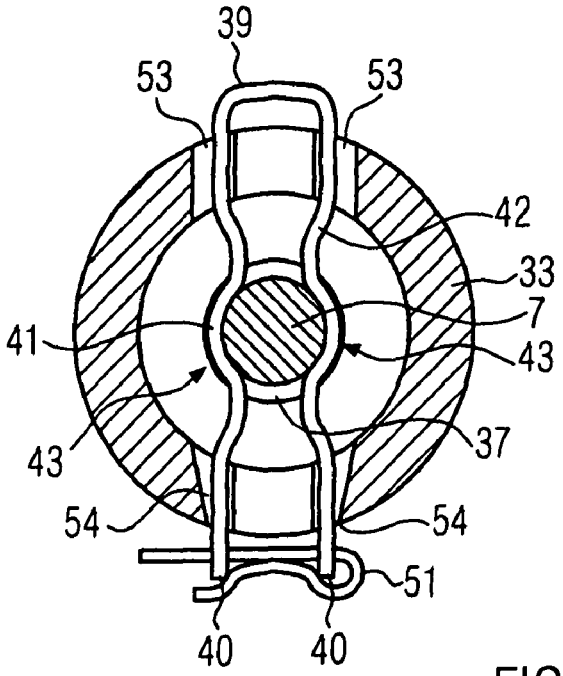
FIG. 3 is a section taken along line III-IIII of FIG. 2.

FIG. 2 shows the spindle 7 in the area of the securing section 34 with a corresponding anti-back rotation means 35. Said anti-back rotation means 35 comprises a locking spring 36, see also FIG. 3, which corresponds to a section taken along line of FIG. 2. This locking spring 36 is substantially U-shaped with two spring legs 41 and 42. These are interconnected at the upper end 39, the spring legs being inserted through openings 53 from above in FIG. 1 into the receiving sleeve 33. In the interior of the receiving sleeve 33, the spring legs 41 and 42 are substantially arranged at opposite sides of the spindle 7 on said spindle, the spring legs in said area extending slightly outwards in curved fashion for better contact.

In FIG. 2, the spindle 7 is arranged in the coupling position 6. In this coupling position, each of the spring legs 41 and 42 grips behind the spring stop 37; see also FIG. 1. Thus, without a spreading of the spring legs 41, 41, an independent axial displacement or back-rotation of the spindle 7 in a direction opposite to the insertion direction 20 is prevented.

The spring legs 41, 42 are guided with their free lower ends 40 through corresponding openings 54 of the receiving sleeve 33 on the outside thereof. A split pin 51 is inserted there into corresponding openings 52 of each spring leg 41, 42 for fixing the locking spring 36 in the arrangement according to FIGS. 2 and 3.

Figure 4:
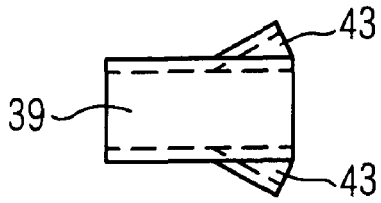
FIG. 4 is a top view on a locking spring of the anti-back rotation device.

At their longitudinal sides oriented towards the engagement section 25, see also FIG. 1, each of the spring legs 41, 42 has an expansion 43 extending in a direction towards the engagement section 25 obliquely outwards. These are shown in FIGS. 2 and 4.

Figure 6:
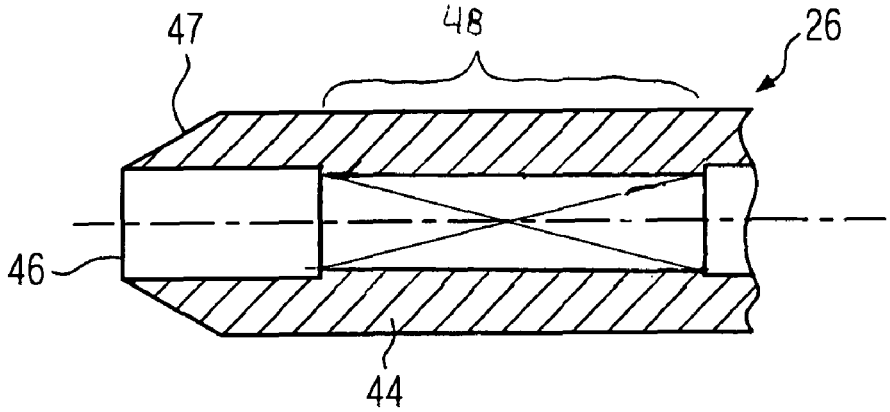
FIG. 6 is a longitudinal section through a rotating means for attachment to the engagement section shown in FIG. 5.

These expansions 43 serve the insertion of a free end 46 of the rotating means 26, see also FIG. 6. The rotating means 26 is arranged on a ROV or the like (not shown). It is also possible that this rotating means 26 is handled by a diver.

Figure 5:
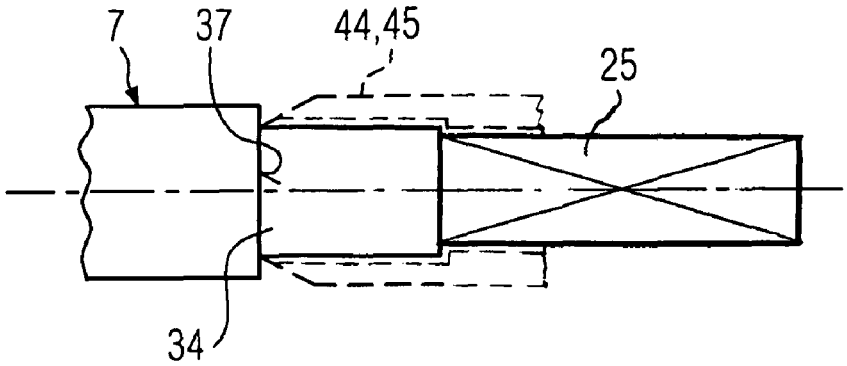
FIG. 5 is a top view on an engagement section of a spindle.

At the free end 46, the rotating means 26, which has a tubular section 44 in the illustrated portion, comprises a cone-shaped insertion edge 47 which is directed obliquely radially outwards and away from the locking spring 36. When the tubular section 44 is attached onto the engagement section 25, said edge gets first into engagement with the expansions 43 of the spring legs 41, 42 and serves to spread the corresponding spring legs. If the free end 46 is arranged in the rotational position 45, see FIG. 5, the spring legs 41, 42 are spread such that they no longer grip behind the spring stop 37.

At the same time, in rotational position 45, a rotating section 48 in the interior of the tubular section 44 is in contact with the engagement section 25 for rotation therewith, so that it is possible to rotate the spindle 7 in back-rotation direction and thus to retract the spindle out of the coupling position 6.

The spindle 7 may here be rotated or turned back for such a long time until the threaded section 10 has been screwed out of the mating threaded section 11 and can thus leave the screw-in bore 18. During this screwing out of the screw-in bore 18 the fluid coupling members 4, 5 are also separated from male part 2 and female part 3. Subsequently, the male part can be fully withdrawn from the receptacle 19 and can be transported, for instance for maintenance or for exchange, to the ocean surface.

The function of the multicoupler according to the invention will now be explained in a few words with reference to the drawings.

In FIG. 1, the male part 2 is already introduced for a major part into the receptacle 19 of the female part 3 by means of, for instance, a corresponding vehicle such as a ROV. The exact alignment of the two parts is accomplished on the one hand through the insertion expansion 50 in the area of the receiving opening 49 and subsequently through engagement of the guide means 21. This alignment also accomplishes an exact assignment of the various fluid coupling members 4, 5 and also of the threaded section 10 relative to the mating threaded section 13. Upon further displacement of the male part 2 in insertion direction 20 a first contact of the threaded section 10 with the mating threaded section 11 is established in the end. It is at least from this time onwards that the spindle 7 is then rotated by the rotating means 26. This spindle can also be operated by the vehicle (ROV), by a diver, or also by a drive means of the male part. In case the male part has a drive means of its own for rotating the spindle 7, this can e.g. be carried out by remote control.

Upon rotation of the spindle 7 threaded section and mating threaded section will be screwed until the threaded section 10 is arranged by way of the desired advance movement fully in the free-rotating chamber 12. As soon as the threaded section 10 has left the mating threaded section 12 forwardly, the fluid coupling members 4, 5 and also the male part and female part 2, 3 are arranged in the corresponding coupling position 6.

During screwing of the threaded section 10 into the mating threaded section 11, the spring element 27 was compressed to a certain degree, and this degree of compression also determines the force acting on the spindle 7 in a direction opposite to the insertion direction 20 and in this connection also the coupling force of the corresponding fluid coupling members 4, 5. This actuation with a force is variable and adjustable through a corresponding selection of the spring element or the length of the threaded section relative to the mating threaded section.

After the mating threaded section 10 has been arranged in the free-rotating chamber 12, the corresponding force actuation is kept constant. A further rotation of the spindle 7 after the coupling position 7 has already been reached does not create any further forces because the threaded section 10 is freely rotating in the free-rotating chamber 12.

When the coupling position 6 is reached, the spring legs 41, 42 simultaneously snap behind the spring stop 37. This excludes an independent axial displacement by rotation of the spindle 7 due, for instance, to vibration, or the like.

To move the male part 2 out of the coupling position 6 again, the rotating means 26 is used according to FIG. 6. This means is provided at its free end with the cone-shaped insertion edge 47 which first gets into contact with the corresponding expansions 43 of each spring leg 41, 42 and spreads the spring legs. This spreading operation is carried out to such an extent that the spring legs are no longer in contact with the spring stop 37. As soon as this has been accomplished, rotating section 48 and engagement section 25 are contacted for rotation so as to permit a back-rotation of the spindle 7 with the threaded section 10 out of the free-rotating chamber 12 through the screw-in bore 18 up into the position shown in FIG. 1. In this position the corresponding fluid coupling members 4, 5 are again separated from one another and the male part 2 can be fully pulled out of the female part 3.

It should additionally be noted that the rotating means 36 for screwing the threaded section into the mating threaded section may be a means differing from the corresponding rotating means 26 for detaching the male part. During the screwing-in operation, for instance, no simultaneous spreading of the spring legs 41, 42 is needed, so that it is essentially only the contact between rotating section 8 and engagement section 26 that must be established to be able to transmit a corresponding rotational force to the spindle 7.

While the invention may be susceptible to various modifications and alternative forms, specific embodiments have been shown by way of example in the drawings and have been described in detail herein. However, it should be understood that the invention is not intended to be limited to the particular forms disclosed. The invention is to cover all modifications, equivalents, and alternatives falling within the spirit and scope of the invention as defined by the following appended claims. Additionally, usage of the term "present invention" or "invention" generally refers to exemplary embodiments of the claimed invention and, as such, subsequent descriptors are not necessarily requirements for every embodiment encompassed by the claims of this application.

The invention claimed is:

1. A multicoupler, particularly for subsea gas or oil production, comprising:

a male part and a female part, each comprising a plurality of fluid coupling members which are capable of being coupled to one another and which are in engagement with one another when the male part and the female part are in a coupling position, wherein one of the male part and the female part comprises a connecting means including a spindle, which, in the coupling position, is in engagement with a mating connecting means on the other part, wherein the connecting means comprises a threaded section rotatable by said spindle and the mating connecting means comprises a mating threaded section and a free-rotating chamber, the threaded section being helically movable, when rotated in a first direction, along the mating threaded section up into the free-rotating chamber within which the threaded section can freely rotate in the first direction while occupying the coupling position without moving the threaded section further along the mating threaded section to connect a subsea device for subsea gas or oil production.

2. The multicoupler according to claim 1, wherein the threaded section is substantially formed at a free end of the spindle.

3. The multicoupler according to claim 1, wherein the female part is stationarily disposed on a subsea device and the male part is movable by at least one of a diver and a remote-controlled vehicle (ROV).

4. The multicoupler according to claim 2, wherein the male and female parts comprise end plates assignable to one another, from which the fluid coupling members project towards the respectively other end plate.

5. The multicoupler according to claim 4, wherein the end plate of the male part comprises a substantially central bearing bore in which the spindle is at least rotatably supported and from which the threaded section of the spindle projects towards the fluid coupling parts.

6. The multicoupler according to claim 5, wherein the end plate of the female part comprises a screw-in bore with the mating threaded section in the extension of which the free-rotating chamber is arranged.

7. The multicoupler according to claim 1, wherein the free-rotating chamber has the male part disposed therein.

8. The multicoupler according to claim 1, wherein the female part comprises a receptacle which is outwardly open towards the male part and along which the male part is displaceable in an insertion direction up into the coupling position.

9. The multicoupler according to claim 8, wherein the receptacle comprises a guide means which extends in the insertion direction and along which the male part is guided to be non-rotational, but axially displaceable.

10. The multicoupler according to claim 9, wherein the guide means comprises at least one guide slot along which a guide bar is movable and which projects substantially radially to the outside from the male part.

11. The multicoupler according to claim 8, wherein the receptacle comprises an insertion expansion in an area of a receiving opening.

12. The multicoupler according to claim 2, wherein, at an end opposite the threaded section, the spindle comprises an engagement section for engagement of a rotating means.

13. The multicoupler according to claim 6, wherein the spindle is acted upon with a force in a direction opposite to the end plate.

14. The multicoupler according to claim 13, the actuation of the spindle by the force depends on the screw-in position of the threaded section in the screw-in bore.

15. The multicoupler according to claim 12, comprising a spring element supported for force actuation between the spindle and the male part.

16. The multicoupler according to claim 15, comprising a spring-element receiving chamber extending partly along the spindle, and wherein the spring element is arranged between a stop end of the spring-element receiving chamber surrounding the spindle and a spring stop connected to the spindle.

17. The multicoupler according to claim 15, wherein the spring element is configured as a helical compression spring.

18. The multicoupler according to claim 16, comprising a bearing bush arranged between the stop end of the spring-element receiving chamber and an open end of a bearing bore at least in part in the longitudinal spindle direction of the bearing bush.

19. The multicoupler according to claim 18, wherein the spindle is arranged substantially from the spring stop to the engagement section within a receiving sleeve of the male part that is open at one side.

20. The multicoupler according to claim 19, wherein the spindle comprises a securing section of reduced diameter next to the engagement section.

21. The multicoupler according to claim 20, wherein the engagement section and securing section have substantially the same diameter.

22. The multicoupler according to claim 20, wherein the spindle has assigned thereto an anti-back rotation means for preventing an independent rotation of the spindle out of the coupling position.

23. The multicoupler according to claim 22, wherein the anti-back rotation means comprises a locking spring which, when the spindle is arranged in the coupling position, rests on a radially outwardly projecting spring stop limiting the securing section towards the spring element.

24. The multicoupler according to claim 23, wherein the locking spring extends substantially in a direction transverse to the longitudinal spindle direction and is detachably fastened at upper and lower ends on the receiving sleeve, and wherein the spring comprises at least two spring legs that can be pressed from the outside onto the spindle.

25. The multicoupler according to claim 24, wherein the spring legs comprise expansions in the area of the spindle in the direction of the engagement section.

26. The multicoupler according to claim 25, wherein the expansions in the direction of the engagement section project over the securing section along the spindle.

27. The multicoupler according to claim 12, wherein the rotating means comprises a rotatable tubular section adapted to be slid onto the engagement section up into a rotational position.

28. The multicoupler according to claim 27, wherein the tubular section comprises an insertion edge disposed at a free end of the tubular section and extending obliquely away from the free end radially outward.

29. The multicoupler according to claim 28, wherein the tubular section is provided away from its free end with a rotating section which is connected for rotation with the engagement section in the rotational position.

30. A multicoupler particularly for subsea gas or oil production comprising:

a plurality of fluid coupling members arranged in two detachably interconnected plug parts and interconnected in a coupling position of said plug parts, wherein the plug parts each comprise connecting means adapted to be screwed to one another when drawn into the coupling position due to rotation in a first direction, wherein, in the coupling position, the connecting means are freely rotatable in the first direction relative to one another without being drawn further together and are prevented from independently leaving the coupling position to connect a subsea device for subsea gas or oil production.

31. A coupler particularly for subsea gas or oil production comprising:

a male part and a female part detachably connected to each other in a coupling position while simultaneously contacting a plurality of fluid coupling members, wherein one of the male part and the female part comprises a rotatably supported spindle which projects towards the other of the male and the female part with a threaded section and which, when the male and the female parts are drawn together, contacts with a mating threaded section formed on the other of the male and the female part, wherein the threaded section is adapted to be screwed to the mating threaded section in a first direction to establish the coupling position, wherein after the coupling position has been reached, the threaded section continues to be freely rotatable in the first direction in a free-rotating chamber following the mating threaded section without drawing the male and female parts together to connect a subsea device for subsea gas or oil production.

* * * * *